United States Patent [19]

Warburg

[11] Patent Number: 4,858,502

[45] **Date of Patent: * Aug. 22, 1989**

[54] CLOSED CONTAINER OPENER

[76] Inventor: Richard J. Warburg, 43 Spruce Dr., Westwood, Mass. 02090

[ * ] Notice: The portion of the term of this patent subsequent to Aug. 4, 2004 has been disclaimed.

[21] Appl. No.: 261,731

[22] PCT Filed: Nov. 9, 1987

[86] PCT No.: PCT/US87/02927

§ 371 Date: Aug. 29, 1988

§ 102(e) Date: Aug. 29, 1988

[87] PCT Pub. No.: WO88/03908

PCT Pub. Date: Jun. 2, 1988

[51] Int. Cl.[4] ..... B67B 7/00

[52] U.S. Cl. ..... 81/3.57

[58] Field of Search ..... 81/3.55, 3.57, 3.07; D8/18, 33, 40

[56] References Cited

U.S. PATENT DOCUMENTS 807,380 12/1905 Hicks .

FOREIGN PATENT DOCUMENTS 527306 4/1954 Belgium .
2508499 2/1975 Fed. Rep. of Germany .
2911086 3/1979 Fed. Rep. of Germany .
931226 7/1946 France .
1156967 12/1957 France .
2044949 2/1971 France .
2420506 10/1979 France .

OTHER PUBLICATIONS

Automatic Test-Tube-Stopper Remover, National Technical Information Service, O.E.B. Doc. Lit., Oct. 19, 1981.

"Cap-Lok Key" Advertisement by Robbins Scientific Corporation.

Laboratory Products Catalogue, Kew Scientific, Inc. for "Stopper Popper" (1982).

*Primary Examiner*—Roscoe V. Parker

[57] ABSTRACT

A closed container opener, particularly a microcentrifuge tube opener (10) is adapted to open a closed container, particularly a microcentrifuge tube (16) comprising a container (30) with an opening (32), and a lid (36) for the container, the lid having a lip projection (38) extending past the outer perimeter of the opening and a downwardly extending annular portion (34) shaped to sealing fit insude the opening. The opener comprises a base (14), having a recess (20) shaped to accept the lip projection, comprising a lower projection (22) below and adjacent the recess; and an upper projection (24) above and adjacent the recess. Both the lower projection and the upper projection are positioned to touch the lip and the lid, respectively. The lid can be moved from the container by positioning the lip in the recess and causing the lower projection to apply pressure to the lip away from the container and, at the same time, causing the upper projection to apply pressure to the tube at a position distant from the lip, in a direction towards the container.

6 Claims, 1 Drawing Sheet

FIG 1
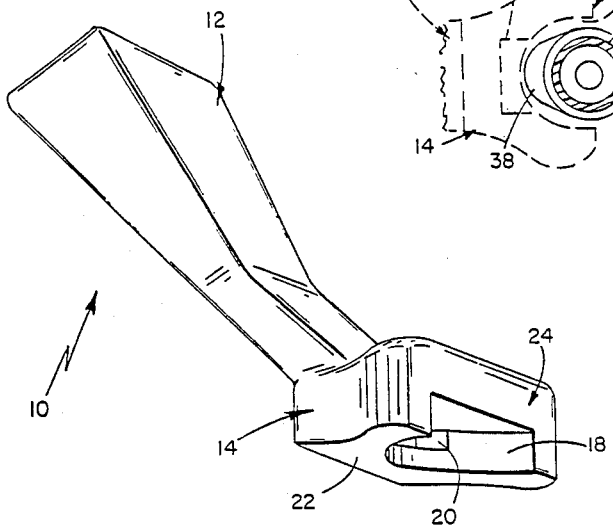
FIG 3
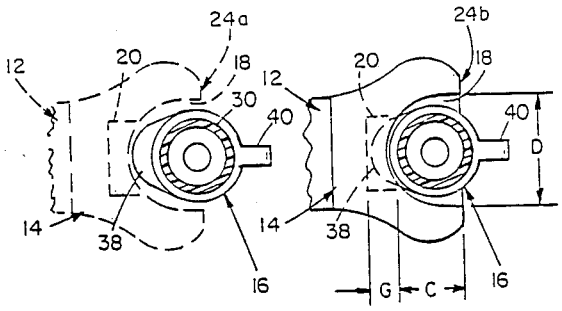
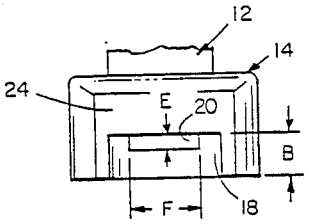
FIG 4
FIG 2
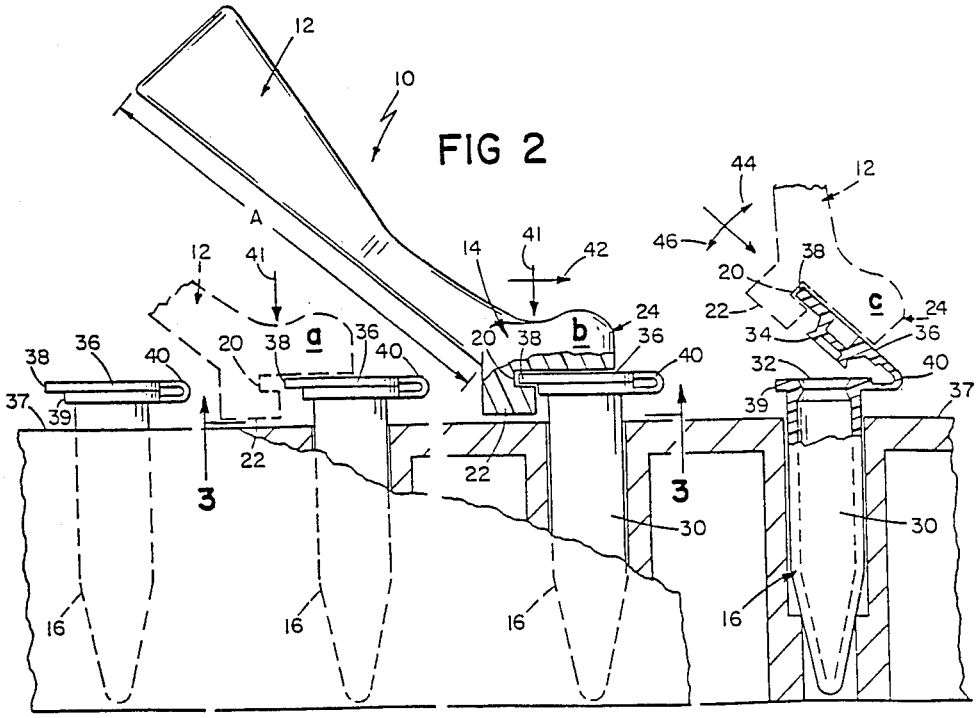

CLOSED CONTAINER OPENER

This invention relates to openers for closed containers such as microcentrifuge tubes, and a method of opening a closed container such as a microcentrifuge tube.

Microcentrifuge tubes are small plastic tubes, generally capable of holding 0.4–1.7 $cm^3$ liquid. They are used widely in biotechnology laboratories for handling radioactively labelled chemicals, and as vessels for storing biochemicals, or for performing biochemical reactions. They have tightly fitting lids with a lip, an example of which is shown in the figures. Generally they are opened by pressing upward on the lip, using a thumb or a conventional beer bottle opener.

This invention features a microcentrifuge tube opener, and method of using the opener, adapted to open a microcentrifuge tube.

According to one aspect of the present invention there is provided a microcentrifuge tube opener adapted to open a closed container such as a microcentrifuge tube, which microcentrifuge tube comprises a container with an opening, and a lid for the container. The lid has a lip projection extending past the outer perimeter of the opening, when the lid is placed above the opening, and a downwardly extending annular portion shaped to sealing fit inside the opening. The opener comprises a base, having a recess shaped to accept the lip projection, comprising a lower projection below and adjacent to the recess, and an upper projection above and adjacent the recess. The lower projection is positioned to engage the lip, and the upper projection is positioned to engage the lid. The lid can be moved from the container by positioning the lip in the recess and causing the lower projection to apply pressure to the lip away from the cup and, at the same time causing the upper projection to apply pressure to the lid at a position distant from the lip in a direction toward the container.

Another aspect of the present invention features a closed container opener adapted to open a closed container such as a microcentrifuge tube comprising a container with a top opening and a lid to seal the opening, the lid comprising a generally circular portion shaped to cover the opening and a lip projecting away from the circular portion, the opener comprising:

a head having a recess, the recess having a upper surface and a lower surface, the surfaces being spaced from each other a distance to allow the lip to be engagingly received therebetween, whereby the lid can be removed from the container opening by engaging the lip in the recess and controlling the upward pressure applied to the lip.

In preferred embodiments, the opener comprises a handle attached to the base.

It is preferred that the base cannot touch the annular portion of the lid when the lid is removed from the container and positioned in the recess.

Preferably, the upper projection extends further from the handle than the lower projection, and, preferably, the longitudinal axis of the handle lies at an acute angle to the plane of the lower surface.

Preferably the lip projection projects from the lid a distance greater than the distance the recess extends into the base.

A further aspect of the present invention comprises a method of opening a closed container such as a microcentrifuge tube comprising using an opener as described above, which method comprises the steps of: positioning the lip in the recess, causing the lower projection to apply pressure to the lip away from the container and, at the same time causing the upper projection to apply pressure to the tube at a position distant from the lip in a direction towards the container.

The opener of this invention permits the ready opening and closing of microcentrifuge tubes even when they have tightly fitting lids. It is important when using these tubes that the inner portion of the lid not be touched by anything which is non-sterile since the enzymes or other chemicals which are commonly present in such tubes are sensitive to contaminating agents (e.g. RNAases and proteases) present on either human fingers or articles touched by humans. In addition, some microcentrifuge tubes must be kept at a constant specific temperature (e.g., −20° C. or 0° C.) when they are used for certain reactions, and it is useful to be able to open them quickly without altering these conditions.

The opener preferably does not touch the inner portion of the lid and thus does not contaminate the contents of the tube. It allows quick opening of tubes, even when held in racks, thus permitting these tubes to be opened without disturbing the temperature of the tube. The opener can be used so that the lid does not fly open, but rather is gently removed from the tube. This prevents the formation of aerosols which occur when the pressure inside a tube is rapidly decreased and thus the contents become airborne. Such an occurence can be extremely dangerous when there is a radioactive solution in the tube; or when bacterial or viral solutions are present in the tube. Further, the opener does not distort or deform the shape of the lid during opening of the microcentrifuge tube.

Other features and advantages of the invention will be apparent from the following description of a preferred embodiment thereof which is by way of example only.

The drawings will first briefly be described.

FIG. 1 is a perspective view of an opener;

FIG. 2 is a sectional view of a series of microcentrifuge tubes and an opener;

FIG. 3 is a plan view of the top of tubes and opener at 3—3 in FIG. 1; and FIG. 4 is a frontal view of the base of an opener.

Referring to the Figures, opener 10 has a handle 12, of length A, about 5 cm, and a base 14. Handle 12 is shaped to fit the contours of the under part of an index finger. Base 14 is shaped to fit snugly around a microcentrifuge tube 16, having a semi-oval shaped recess 18 (of depth B, about 0.5 cm; length C, about 1 cm; and width D, about 1 cm), and a largely rectangular recess 20 (of depth E, about 0.2 cm; width F, about 0.7 cm; and length G about 0.2 cm). Base 14 consists of a lower projection 22 below recess 20 and an upper projection 24 above recesses 18 and 20. Arm 24 also defines the sides of recesses 18 and 20 and is fused to lower projection 22.

Opener 10 is manufactured from a hard autoclavable plastic, such a acrylic, by standard procedures.

Opener 10 is useful for opening microcentrifuge tubes having a lid with a lip projection, such as tube 16 having a lid 36 with lip 38 extending past the outer perimeter 39 of the tube, shown in the figures. Microcentrifuge tube 16 consists of a container 30 with an opening 32 in which an inner portion 34 of lid 36 fits snug. Lip projection 38 projects about 0.2 cm from the outer perimeter 39 of lid 36. Lid 36 is attached by a hinge 40 to container 30.

Referring to FIGS. 2, 3, in order to open a closed microcentrifuge tube 16 (FIG. 2*a*), held in a tube rack 37, opener 10 is positioned so that lip 38 of the tube 16 is facing toward recess 20 of the opener, and upper projection 24 is then pressed down as shown by arrow 41 onto lid 36. Opener 16 is then slid, as shown by arrow 42, towards lip 38 until lower projection 22 approaches the outer perimeter of container 30 (FIG. 2*b*). The two sides of upper projection 24 aid in making sure that lip 38 is positioned to enter recesses 18 and 20 in turn. When lip 38 is positioned inside recess 20, opener 16 is caused to turn, as shown by arrow 44, so that lower projection 22 exerts upward pressure on lip 38, and upper projection 24 exerts slight downward pressure on lid 36. In this way lid 36 is removed from opening 32 in container 30 (FIG. 2*c*). The microcentrifuge tube 16 may be closed by reversing this action, as shown by arrow 46, or by pressing it shut using a finger.

Opener 10 can be readily used when tube 16 is held in an operator's hand rather than in a rack 37. When a plurality of tubes 16 are held in a rack 37, as shown in FIG. 2, then opener 10 can be used to open each tube in turn without the other tubes interfering with the process.

The handle 12 may, for example, be short and hollow to allow insertion of a finger into the handle.

I claim:

1. A microcentrifuge tube opener adapted to open any microcentrifuge tube comprising a container with an opening, and a lid for the container, the lid having a lip projection extending past the outer perimeter of the opening in essentially one direction, when the lid is placed above the opening, the lip projection extending along a first axis located centrally in the lid and passing from the lid to the lip projection, and a downwardly extending annular portion shaped to sealing fit inside the opening, the opener comprising a base, having a recess shaped to accept the lip projection, and an opening sized to allow access of the lip projection to said recess, the base comprising:

a lower projection below and adjacent the recess, and an upper projection above and adjacent the recess, wherein the lower projection is positioned to engage the lip during use to open said microcentrifuge tube, and the upper projection is positioned to engage the lid during said use, wherein said recess is defined by a perimeter wall, and wherein a second axis is defined by a centrally located line passing from said wall to said opening, said wall being positioned to abut said lip projection and thereby prevent said annular portion from contacting said base when said lip projection is positioned in said recess, with a portion of said lip projection furthest from said lid abuting said wall, and with said first axis aligned parallel with said second axis;

wherein the lid can be moved from the container by positioning the lip in the recess and causing the lower projection to apply pressure to the lip away from the container and, at the same time causing the upper projection to apply pressure to the lid at a position distant from the lip in a direction towards the container; wherein the base does not touch the annular portion of the lid of any said microcentrifuge tube when the lid is removed from the container, and the lip is positioned in the recess with said first and second axes aligned parallel to each other.

2. The opener according to claim 1, further comprising a handle attached to the base.

3. The opener according to claim 2 wherein the upper projection extends further from the handle than the lower projection.

4. The opener according to claim 2 wherein the longitudinal axis of the handle lies at an angle greater than 0° to the plane of the lower surface.

5. The opener according to claim 1 wherein the lip projection projects from said lid a distance greater than the distance the recess extends into the base.

6. A method of opening any microcentrifuge tube comprising using an opener according to claim 1 which method comprises the steps of:

positioning the lip in the recess, causing said lip to abut said wall, and causing the lower projection to apply pressure to the lip away from the container and, at the same time causing the upper projection to apply pressure to the tube at a position distant from the lip in a direction towards the container.

* * * * *